US008653376B2

(12) United States Patent
Birrer et al.

(10) Patent No.: US 8,653,376 B2
(45) Date of Patent: Feb. 18, 2014

(54) CORONA SHIELD AND COMPOSITE INSULATOR WITH CORONA SHIELD

(75) Inventors: Thomas Birrer, Malters (CH); Hansruedi Gassmann, Malters (CH); Werner Albisser, Malters (CH); Leo Arnet, Emmen (CH); Frank Schmuck, Eschenbach (CH)

(73) Assignee: Pfisterer Sefag AG, Malters (CH)

( * ) Notice: Subject to any disclaimer, the term of this patent is extended or adjusted under 35 U.S.C. 154(b) by 617 days.

(21) Appl. No.: 12/462,495

(22) Filed: Aug. 4, 2009

(65) Prior Publication Data

US 2011/0030993 A1 Feb. 10, 2011

(51) Int. Cl.
*H01B 17/44* (2006.01)
*H01T 19/02* (2006.01)

(52) U.S. Cl.
USPC ..... 174/140 CR

(58) Field of Classification Search
USPC ..... 174/140 CR
See application file for complete search history.

(56) References Cited

U.S. PATENT DOCUMENTS

| | | | | |
|---|---|---|---|---|
| 3,898,372 | A | 8/1975 | Kalb | |
| 4,355,200 | A | 10/1982 | Wheeler et al. | |
| 6,388,197 | B1 | 5/2002 | Zhao et al. | |
| 6,984,790 | B1 | 1/2006 | Bernstorf | |
| 7,709,743 | B2 * | 5/2010 | Bernstorf et al. | 174/140 R |

FOREIGN PATENT DOCUMENTS

| | | |
|---|---|---|
| EP | 2 071 592 A1 | 6/2009 |

* cited by examiner

*Primary Examiner* — William H Mayo, III
*Assistant Examiner* — Hiram E Gonzalez
(74) *Attorney, Agent, or Firm* — Von Rohrscheidt Patents

(57) ABSTRACT

A composite insulator comprises a rod with an insulating jacket and ribs and at least one end fitting and at least one corona shield. The latter is integrally manufactured from plastic material. It is configured to be coaxially disposed on the composite insulator at the transition from the rod to the end fitting. The corona shield forms a cavity, which is open towards the inside and which can be filled with sealant compound through at least one filling channel and which comprises a closing cuff in axial direction on both sides for sealing the cavity. The diameter of the rod side closing cuff is adapted to the diameter of the insulating jacket, and the diameter of the fitting side closing cuff is adapted to the diameter of the end fitting. The filling channel leads to the cavity from the outside.

4 Claims, 4 Drawing Sheets

CORONA SHIELD AND COMPOSITE INSULATOR WITH CORONA SHIELD

FIELD OF THE INVENTION

The present invention relates in general to insulator technology, and in particular to a corona shield made of insulating plastic material, and it also relates to a composite insulator with at least one such corona shield.

BACKGROUND OF THE INVENTION

High voltage composite insulators typically comprise an insulating rod (mostly made of glass fiber reinforced hard plastic material), which absorbs the mechanical loads, a jacket and ribs made of insulating plastic material (mostly a plastic material with hydrophobic or contaminant repellant surface, like silicon rubber) is disposed above said rod a, and they comprise end fittings (mostly made of metal) permanently connected to the rod, which are used as mounting devices.

Corona discharges quite frequently occur in a high voltage insulator under voltage. Such a corona discharge can have an eroding effect upon the insulating jacket. Thus, it can pit the surface of the insulating jacket in particular proximal to the end fittings, because the field strength is generally very high in that area, and thus the corona discharge can reduce the service life of the insulator.

It is a common countermeasure to form the electrical field at the end fitting by means of so-called corona rings made of conductive material, mostly metal or semi-conductive material, mostly plastic intermixed with conductive particles, which corona rings are often mounted at the end fitting, so that the field strength is reduced. This reduces the propensity for a corona discharge, or it reduces at least the concentration of the corona discharge at the surface of the insulator jacket proximal to the end fitting.

Alternatively, the printed document U.S. Pat. No. 6,984,790 B1 describes a corona shield made of metal, which is assembled from two metal half shells over the insulator at the interface between the rod and the end fitting. A cavity formed by the metal half shells is then filled by a sealant compound.

As discussed, also semi-conducting corona shields are known, e.g. from U.S. Pat. Nos. 6,388,197 B1 and 4,355,200.

Such field forming measures, however, are rather complex, and additionally they are often not sufficient for actually preventing critical corona discharges. Field forming is therefore omitted in many composite insulators. It has already been suggested for such insulators to better protect the insulating jackets close to the rod against erosion by means of insulating material with greater wall thickness. Namely through the greater wall thickness, it takes longer until corona discharge induced erosion permeates the insulator wall in said particularly exposed portion. Thus, the service life reducing effect of the corona discharge is compensated by said measure. Furthermore, the corona shield can also be used for sealing the interface between rod and end fitting, e.g. against rain water. An embodiment of a composite insulator with such a corona shield made of insulating material is known from the printed document U.S. Pat. No. 3,898,372.

However, the composite insulator known from U.S. Pat. No. 3,898,372 is not to be considered optimum with respect to service life and manufacturing complexity. Thus, it is the object of the present invention to provide a composite insulator with a long service life, which can still be produced with rather low complexity. This also includes providing a coronal shield, which facilitates producing such insulator.

BRIEF SUMMARY OF THE INVENTION

The invention relates to a corona shield for a composite insulator, wherein the latter comprises a rod with insulating material and ribs and at least one end fitting. The corona shield is integrally made from plastic material. It is configured to be coaxially disposed at the interface between the rod and the end fitting. Thus, the corona shield forms an inward open cavity. Said cavity can be filled with sealant compound through at least one filling channel. It comprises an end cuff on both sides in axial direction in order to seal the cavity. The diameter of the closing cuff at the rod side is adapted to the diameter of the insulating jacket and the diameter of the closing cuff at the end fitting side is adapted to the diameter of the end fitting. The filling channel leads to the cavity from the outside.

Another aspect of the invention relates to a composite insulator, which comprises a rod with an insulating jacket and ribs, at least one end fitting and at least one corona shield of the type described supra. The insulating jacket and the ribs are made from insulating plastic material. The corona shield is produced as a separate shaped component. It is coaxially disposed on the composite insulator at the interface from the rod to the end fitting. Its cavity is filled with sealant compound.

Other features are inherent in the disclosed products and methods or will become apparent to those skilled in the art from the following detailed description of embodiments and the accompanying drawings.

BRIEF DESCRIPTION OF THE DRAWINGS

Embodiments of the invention will now be described in an exemplary manner with reference to the accompanying drawing figure, in which:

FIG. 4 illustrates a glue joint of the corona shield with the insulator jacket;

FIG. 5 illustrates is the case of a corona shield provided with a semi-conducting layer and the case of separately produced ribs, which are connected to the insulation sleeve through a glue joint.

DETAILED DESCRIPTION OF THE INVENTION

Figure 1:
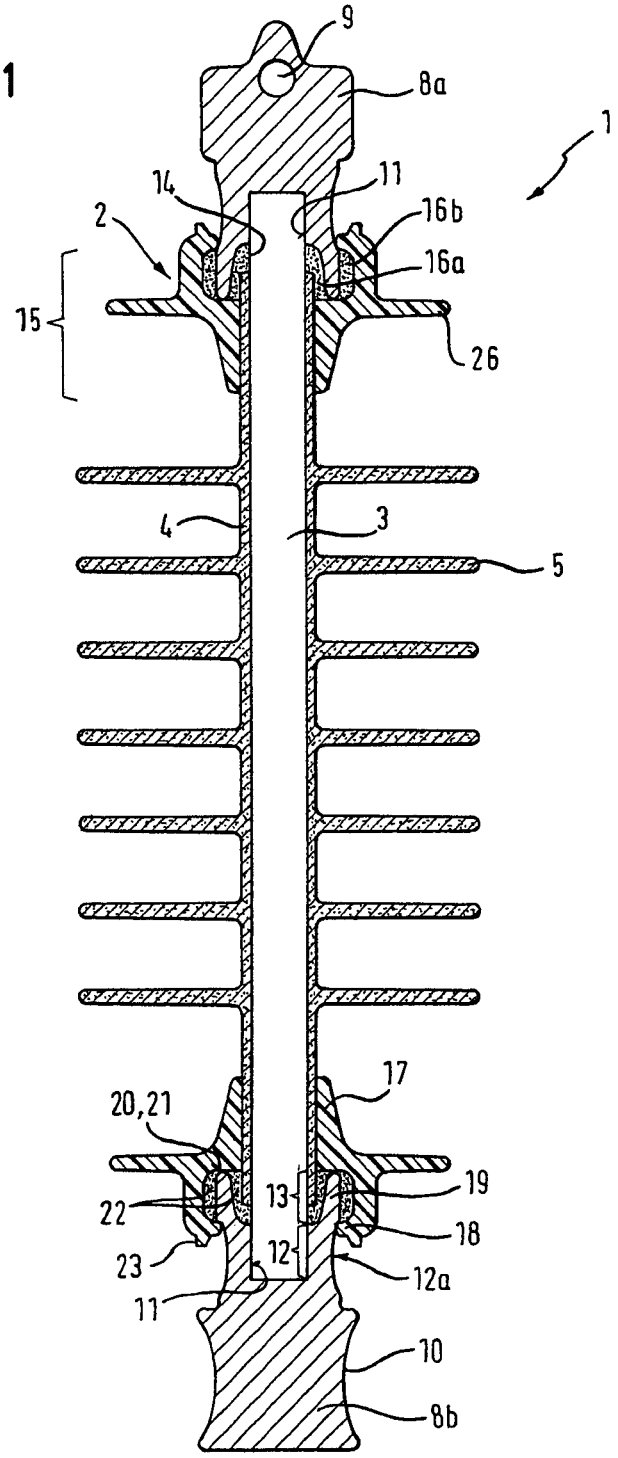
FIG. 1 shows a schematic illustration of a longitudinal cut view of an embodiment of a composite insulator with a corona shield at each of its two ends.

Before giving a detailed description of the drawing figures, the preferred embodiments are described initially.

The embodiments relate to high voltage insulators and corona shields for such insulators. "High voltage" is interpreted here in a general sense, which comprises medium voltage, high voltage (in a more restrictive sense) and ultra-high voltage, thus from 1 kV to several 100 kV.

The composite insulators according to the embodiments, subsequently sometimes also briefly designated as "insulators", comprise a centrally extending rod, thus forming the longitudinal axis of the insulator, often also designated as core or trunk. The rod is e.g. cylindrical with circular or non-circular cross section. It is used for receiving tension-, compression-, shear and/or torsion forces, and thus provides the necessary mechanical stability for the insulator. The rod is electrically conductive and made e.g. of a glass fiber reinforced hard plastic material, e.g. hardened synthetic resin. It can be provided solid or tube shaped.

The rod is configured at one or both ends with an end fitting typically made of metal. Said end fitting is used for connecting the insulator to a support structure, to a conductor of an electrical line, or to another insulator, etc. In most embodiments, the composite insulator has such an end fitting at both ends. However, there are also special versions with only one end fitting provided as an attached formed metal component. At the other end, the insulating material of the insulator is then formed e.g. into a mounting device (re. e.g. WO 03/081610). Subsequently, e.g. one end fitting (singular) is recited, but two end fittings are also recited. This, however, only facilitates the simplicity of the verbal description, and therefore does not imply that the respective versions only relate to embodiments with one end fitting, or with two end fittings. They rather always relate to both types of embodiments.

The end fittings are permanently connected to the rod in both embodiments. The connection is performed e.g. through crimping the end fitting in the portion of a hole in the end fitting extending in axial direction, into which hole the rod is inserted. This creates a permanent friction locked press fit between the end fitting and the rod.

The rod comprises an insulating jacket made of insulating plastic material and it is furthermore provided with ribs, also made of insulating plastic material, which are used for extending the creeping distance. Such ribs are often also designated as "shields". In order to prevent a mix-up with the term "corona shield", the designation "ribs" is used in the present text. In some embodiments, the insulating jacket and the ribs are made of an elastomer, however, using a non rubber-elastic harder plastic material, e.g. a hard rubber material is possible. The plastic material for the insulating jacket and for the ribs is e.g. selected from the hot- or cold vulcanizing elastomers (e.g. Silicon EPDM), or from the thermoplastic elastomers. It is preferably a silicon rubber, thus a vulcanized product made from natural silicon rubber, which can e.g. be vulcanized through hot crosslinking. It is preferably a vulcanized natural silicon rubber product with methyl- and vinyl groups at the polymer chain (e.g. VMQ according to ISO 1629).

There are several options to produce the insulating jacket and the ribs:

(i) The insulating jacket and the ribs can be manufactured separately. In some embodiments the insulating jacket is e.g. molded onto the rod e.g. by means of an extruder. Prefabricated ribs are slid over the partially or completely vulcanized insulation sleeve then and they are connected to said insulating sleeve, e.g. through a glue joint. The prefabricated ribs can be made from another plastic material, than the insulating jacket, when the ribs are manufactured separately;

(ii) the insulating jacket and the ribs can be jointly produced, e.g. by casting plastic insulating material around the rod. Thus, in such embodiments, the ribs are not prefabricated, but they are integrally cast around the rod with the insulating jacket. Different from using prefabricated ribs, no microstructure border similar to a glue interface between an insulating jacket and rib, is created.

In the various embodiments, the composite insulator is furthermore configured with at least one corona shield. Herein, a "corona shield" is a sleeve type structure, which is disposed at the interface between the rod and the end fitting, thus where a corona discharge typically has the greatest eroding effect, which is different from the structures designated as "ribs", which are disposed further towards the center of the insulator on the rod. In some embodiments, the corona shield comprises one or plural ribs, which extend towards the outside, thus it is similar to the "ribs" in this respect. In other embodiments, the corona shield, on the other hand, has no rib configuration. Insulators with two end fittings generally have two corona shields, said special configuration with only one end fitting accordingly only has one corona shield.

The corona shield is manufactured from plastic material as a separate formed piece, e.g. from a plastic material of the type recited supra in conjunction with the insulating jacket and the ribs, it is made e.g. from silicon rubber.

The embodiments of the composite insulator, which are manufactured according to the method (ii) recited supra, thus form a hybrid configuration, in which the insulation sleeve and the ribs are jointly produced by casting around the rod on the one hand, in which, however, the corona shield or the corona shields are installed in the compound insulator as separately produced formed components on the other hand.

In most embodiments, the corona shield is fabricated entirely from electrically insulating material. In other embodiments, the corona shield is formed partially from semiconducting material by providing, e.g. the base body of the corona shield, which is made from insulating plastic material of the type recited supra, with a semiconducting layer at its inner surface or at a portion thereof. This can be performed by applying a semiconducting lacquer. In other embodiments, the corona shield is made of semiconducting plastic material overall, thus from the type recited supra in conjunction with the insulating jacket and the ribs, thus e.g. from silicon rubber which, however, is provided with an additional material providing conductivity.

In some embodiments, the corona shield forms an internally open cavity in not yet installed condition. Said cavity can be filled with sealant compound. The corona shield comprises a closing cuff in axial direction on both sides for sealing the cavity. For this purpose, the inner diameter of the closing cuff is adjusted on the fitting side to the outer diameter of the end fitting in the portion covered by the cuff. The rod side closing cuff is not directly positioned on the rod surface in some embodiments, but it is placed on the surface of the insulator jacket. Accordingly, the inner diameter of the rod side closing cuff is adapted to the outer diameter of the insulating jacket in order to seal the cavity.

An "adapted diameter" of the closing cuffs is perceived herein as a diameter which provides sufficient sealing of the cavity against the leakage of not yet hardened sealant. In other words, there is a fit between the corona shield and the insulating sleeve, so that in some embodiments, with the corona shield not yet installed, the inner diameter of the rod side closing cuff is slightly smaller than or identical to the outer diameter of the insulating jacket, e.g. 0% to 30% smaller than the outer diameter of the insulating jacket. During assembly, the corona shield is elastically expanded, so that it can be slid over the insulating jacket. The closing cuff then loads the insulating jacket elastically, which yields a particularly effective and durable seal. Accordingly, in said embodiments, the inner diameter of the fitting side closing cuff is slightly smaller than, or equal to the outer diameter of the end fitting in the overlap portion, which is of interest here, e.g. 0% to 30% smaller than the outer diameter of the end fitting.

In order to be able fill the cavity with sealant material in a simple manner, the corona shield comprises at least one filling channel, which leads to the cavity from the outside. The sealant compound is electrically insulating in most embodiments. The sealant compound is e.g. a cold hardening silicone gel, which forms e.g. a two-component system. The two components are mixed shortly before induction into the cavity and they harden cold in the cavity after the induction into the cavity. The sealant compound hardened in the cavity then covers the portion of the insulator disposed under the cavity in a sealing manner. This prevents in particular the penetration of water in this portion.

Besides the sealing effect, the corona shield, as expressed by its name, provides certain protection against the eroding effect of corona discharges by increasing the entire thickness of the insulating material on the rod proximal to the end fitting. In order to reinforce said protective effect, the rod side closing cuff extends in some embodiments further towards the center of the insulator, than it would be required for obtaining the sealing of the cavity only. Said closing cuff thus forms a cover grommet, which reaches around the insulating jacket, and thus increases the entire thickness of the insulating material on the rod proximal to the end fitting. In some embodiments, the cover grommet surrounds the insulating jacket accordingly, thus it is not a portion of the cavity in the corona shield. In some embodiments, the length of the cover grommet comprises more than half the entire length of the corona shield, and in some embodiments, it even comprises more than ⅔ of the entire length (said lengths relate to the longitudinal direction of the insulator). In some embodiments, the cover grommet comprises a conically tapered outer cross section in its half oriented towards the center, according to the erosion effect of the corona discharge, which is reduced with increasing distance from the end fitting.

In some embodiments, the boundary surface between the insulating jacket and the rod side closing cuff or of the cover grommet is entirely or partially glued with a glue, in order to produce the composite insulator. For example, after the installation of a corona shield, suitable glue (e.g. silicon glue) is inserted between the closing cuff or the cover grommet and the insulating jacket, e.g. the glue is injected at this location by a certain type of injection needle. A particularly effective seal is provided in particular in corona shields, whose closing cuff or cover grommet has a smaller diameter on the inside than the insulating jacket, whereby the closing cuff elastically compresses the insulating jacket in assembled state.

Typically, the exterior diameter of the end fitting is greater than the exterior diameter of the insulating jacket, since the end fitting generally receives the rod in a hole. Accordingly, in some embodiments, the exterior diameter of the rod side closing cuff is greater than the exterior diameter of the end fitting side closing cuff.

In some of the embodiments, the rod is crimped together with the end fitting in a hole of the end fitting. The interface, at which the rod enters the compression portion, is covered by the cavity in the corona shield and it is sealed by sealant compound disposed in said cavity.

As a matter of principle, it is possible in embodiments in which the insulating jacket and the ribs are integrally produced through casting about the rod, to also cast about the rod side end of the end fitting during the casting process. Then, the insulating jacket also covers the interface between the rod and the end fitting, and thus also provides a seal for the interface. Casting about the end fitting, however, can also cause manufacturing problems, since the end fitting generally has to be preheated for the casting method, in order to assure a correct vulcanization of the cast plastic material. Due to the generally different thermal expansion coefficients of end fitting and of the rod, or of the glass transition temperature of the rod, said heat-up can degrade the strength of the press fit between the end fitting and the rod. Therefore, it may sometimes be required when casting over the end fitting, to post-compress said press fitting after casting. Therefore, the insulating jacket is not cast about the end fitting in most embodiments in order to avoid said problem. Therefore, preheating the end fitting is certainly not required in this case. The non-jacketed interface between the rod and the end fitting thus created is covered by the corona shield and sealed.

Generally, jacketing the rod is still performed before the end fittings are mounted at the rod and e.g. pressed together therewith. In order for the rod to be insertable into the end fittings after casting, and in order to be e.g. crimpable with them, the rod ends are not jacketed in most embodiments. Thus, no insulating jacket is cast in these embodiments in the end portion of the rod, where it is inserted into a hole in an end fitting and crimped together therewith. Generally, the cast insulating jacket thus does not extend exactly directly to the end portion to be kept open, but it terminates exactly a short distance in front of it, e.g. in the order of magnitude of 1 mm. Furthermore, maintaining a distance of this magnitude is also useful in order to assure that the rod can actually be completely inserted into the hole of the end fitting. As a consequence, there is an interface at the transition from the rod to the end fitting where, viewed from the center of the insulator, the portion of the rod begins, which portion is impressed into the end fitting, where the rod surface is initially provided without a cast insulating jacket. At this location, in principle, there would be a risk that water can penetrate between the rod and the insulating jacket and can then creep possibly along the rod on the inside. In said embodiments, however, the corona shield cavity covers said interface with an initially free rod surface, and the sealant compound inducted into the cavity seals it. The corona shield thus prevents in these embodiments that water can penetrate between the rod and the insulating jacket.

As already recited supra, the corona shields described herein are formed components, which can be manufactured separately. Thus, the present description does not only relate to composite insulators, which are configured with such corona shields, but it also relates to a corona shield itself, which is configured to be installed in a composite insulator.

As recited supra, the corona shield is configured integrally from an insulating plastic material, and suitable to be coaxially disposed on a composite insulator at the transition from the rod to the end fitting. The corona shield comprises a cavity that is open to the inside. Said cavity can be filled with sealant compound. The corona shield thus comprises a closing cuff at both of its axial ends for sealing the cavity. Thus, the diameter of the rod side closing cuff is adapted to the diameter of the insulating jacket, and the diameter of the closing cuff at the side of the end fitting is adapted to the diameter of the end fitting. Thus, the corona shield forms a type of "lost mold" for the sealant compound, which is initially inducted into the cavity in flow capable condition. The sealant compound, which is not yet hardened, remains enclosed in said mold. After hardening the sealant compound, said mold remains at the insulator and protects the interface together with the hardened sealant compound. In some embodiments, at least one filling channel is provided for filling the cavity with sealant compound, which filling channel leads to the cavity from the outside. Some embodiments have two filling channels of said type, which are disposed opposite to one another, for example, a sealant compound is injected through one of the two channels and the air displaced from the cavity discharges through the other channel.

Filling the cavity with sealant compound is performed in the latter embodiments e.g. as follows: a composite insulator, which is completed besides filling the cavity, is oriented, so that the two filling channels of a corona shield extend vertically. Thus, one of the filling channels is disposed below the insulator axis, the other one is disposed above it. Then, flow capable sealant compound is injected into the lower filling channel from below. Thus, the cavity slowly fills up and, due to the effect of gravity, no hollow spots are left in the cavity when it is filled from the bottom up. The air thus displaced exhausts from the cavity through the upper filling channel. The injecting is performed until the sealant compound starts to leak from the top of the upper filling channel. Subsequently, the opening of the lower filling channel and possibly also the opening of the upper filling channel are closed, e.g. by inserting a plug or through a self acting closure element, e.g. an integrated lid in the filling channel, which acts as a blowback flap. Also, when the upper filling channel is closed e.g. by means of a plug, the composite insulator can be brought into another position due to the complete sealing of the cavity then accomplished, it can e.g. be suspended vertically, without having to wait for the hardening of the sealant compound, which is still flow capable initially. However, when the cavity is not closed, the composite insulator remains in a position in which the upper filling channel points upward until the sealant compound is hardened.

As discussed, the corona shield does not only envelope the cavity like a lost mold in some embodiments, but it rather extends further in axial direction to the center of the insulator in order to increase the protection against corona discharge induced erosion. The rod side closing cuff then forms a cover grommet, which envelopes the insulating jacket, and thus increases the total thickness of the insulating material on the rod proximal to the end fitting.

In order to mount the rod in the end fitting, a hole is provided in some embodiments in the end fitting, which hole extends in longitudinal direction of the insulator and into which hole the rod is inserted and mounted through crimping the wall of the hole. In some embodiments, the crimping portion extends to the entrance of the hole. Thus, the interface between the rod and the crimping portion is then disposed at the face of the end fitting, which face comprises the hole, and the short piece, at which the surface of the crimped rod is provided without insulating jacket, is thus disposed axially outside of the end fitting in front of the face of the end fitting. The cavity of the corona shield covers the face of the end fitting and the portion with the open rod surface.

In other embodiments, the hole in the end fitting has two sections with different hole diameters, of which the portion at the hole entry comprises a significantly larger diameter than the rod (without insulating jacket), and thus is not part of the crimping portion, whereas the diameter of the section which is disposed lower in the hole corresponds to the diameter of the rod without the insulating jacket and forms the crimping portion. Different from the embodiments recited in the preceding section, herein the interface between the rod and the crimping portion thus is not on the outside at the face of the end fitting, but it is deeper inside in the hole, and thus viewed from the center of the insulator in axial direction, in front of the location, where the hole contracts and where the second hole section forming the crimping portion begins. In some embodiments, care is taken during casting of the insulating jacket that the portion of the rod with open rod surface, disposed in front of the interface, is shorter than the hole section with larger diameter. Thus, put differently, the insulating jacket extends, viewed from the center of the insulator, in axial direction into the hole, and the entire rod section with open surface is disposed entirely in the hole section with larger hole diameter. Thus, viewed in radial direction, the end fitting covers the rod piece with open surface. The portion of the cavity in the interior of said hole section, which forms an inner portion of the cavity, and also the portion of the cavity outside of the end fitting, which forms an outer portion of the cavity, are filled with sealant in the finished insulator. Thus, the interface between the rod and crimping portion is protected in multiple ways: it is covered twice, namely on one side covered by the wall of the hole of the end fitting, and on the other side, covered by the corona shield, which surrounds the wall of the hole. Furthermore, the inner- and the outer cavity formed thereby are filled with sealant compound.

The hole section with larger diameter is not closed towards the insulating jacket at the face of the end fitting, viewed in axial direction. Rather, an initially open annular gap between the insulating jacket and the wall of the hole is initially provided at this location.

In some embodiments in which the cavity of the corona shield extends beyond the end fitting face in axial direction towards the center of the insulator, said annular gap is used for passing the sealant, which is flow capable during filling, into the inner cavity. Thus, it is assured that the entire cavity, and not only the outer cavity, is filled with sealant compound.

In some embodiments, however, the corona shield is configured to close the annular gap at the face of the end fitting completely or to a large extent. For this purpose, it comprises an e.g. substantially radially extending shoulder in its cavity, which is configured for contacting the face of the end fitting.

In some of these embodiments, the cavity does not extend beyond the shoulder in the direction towards the center of the insulator. The cuff on the side of the rod disposed beyond said shoulder contacts the insulating jacket snug. The shoulder thus forms the termination of the cavity in the direction towards the center of the insulator in these embodiments.

When an embodiment of the corona shield with such a shoulder contacts the face of the end fitting in installed condition of the corona shield, the step covers the annular gap, and the end fitting wall in the portion of the hole section with the largest hole diameter and the step in the corona shield cavity separate the inner- and the outer cavity from one another. The inner cavity is defined in outward direction by said hole wall of the end fitting and by the shoulder, while the outer cavity is defined by the corona shield in outward direction.

Strictly speaking, if the shoulder were to completely seal the annular gap, the cavity would be split in two partial cavities through such division, which partial cavities are not in fluidic communication with one another. In some embodiments, therefore additionally at least one connection channel is provided, which bridges the end fitting contacting the shoulder through fluid communication, thus establishing fluid communication between the outer- and the inner cavity. The connection channel extends e.g. in the shoulder. The fluidic communication connection of the two partial cavities assures that the entire cavity, and thus not only the outer cavity, is completely filled with sealant, and thus assures that the desired sealing function is achieved to its full extent.

For the design variant, where the corona shield attached to the top of the insulator forms a small depression, another measure can be provided for avoiding a collection of contaminant and water, thus a rainwater drain attached to the corona shield, provided in the form of one or plural grooves. These protrude e.g. at least at one of the axial ends of the corona shield in axial direction, thus forming a low spot at which raindrops collect, which then drip off from there. Once dripped off, the water does not reach the interface between the end fitting and the rod disposed closer to the axis.

As recited supra, the corona shield is produced completely from electrically insulating material in most embodiments. In other embodiments, the corona shield is partially made of semiconducting material, by providing e.g. the base body of the corona shield at its inner surface or at a portion thereof, thus the cavity wall with a semiconducting layer, e.g. a semiconducting lacquer. In other embodiments, the entire corona shield is made of semiconducting plastic.

Subsequently, some descriptions are provided regarding the overall production of composite insulators.

In embodiments with separately produced ribs, the insulating jacket is initially imparted onto the rod by means an extruder. After its complete or partial hardening, the prefabricated (also entirely or partially hardened) ribs are pulled over the enveloped rod and they are brought into a respective mounting position along the rod, wherein they are expanded slightly using their elasticity in order to facilitate their movement on the rod sleeve.

In other embodiments, the insulating jacket and the ribs, on the other hand, are cast over the rod jointly.

Subsequently, in both embodiments, a prefabricated corona shield of said type is slid over the enveloped rod, and possibly expanded for this purpose, in order to fit over the insulating jacket. Then, pressing the end fittings onto the non-enveloped rod ends is performed. The corona shields are then slid back, so that they are placed at the interface between end fitting and rod, covering said interface. Then, a sealant (e.g. two component silicone gel) is injected through a lower filling channel. The air thus displaced from the cavity exhausts through the upper filling channel. When sealant compound exits from the upper filling channel, this indicates the complete filling of the cavity, which terminates the injection process. If necessary, glue, e.g. silicon glue, is injected between the rod side closing cuff, e.g. the cover grommet, and the insulation sleeve. After hardening the sealant compound and possibly the glue, the compound insulator is completed.

Now reverting to FIG. 1, a longitudinal sectional view of a high-voltage composite insulator 1 with corona shields 2 is shown. The composite insulator 1 is mostly mounted in a downward hanging configuration, but it can also be used in horizontal or vertical configuration. For this purpose, it comprises a tension, compression, bending and torsion proof insulating rod 3, extending along the longitudinal axis of the insulator, which rod is made e.g. from a glass fiber reinforced duroplastic material. The rod 3 is cylindrical; this means its cross section is constant over its entire length.

The rod 3 is enveloped on its outer surface by a sleeve 4 made of insulating elastomeric material. The insulating jacket 4 forms ribs 5, e.g. in regular distances, which ribs are e.g. made from the same elastomeric material as the insulating jacket 4. The ribs 5 are used for extending the creep path. They can comprise different diameters, e.g. in alternating sequence. In order to further extend the creep path, they can e.g. be configured with grooves at their bottoms.

Figure 4:
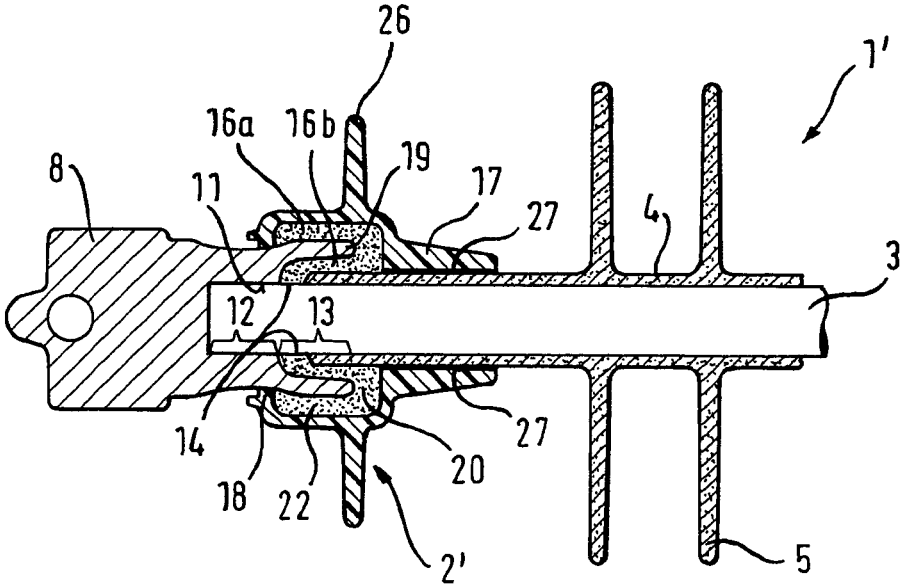
FIG. 4 shows a respective schematic longitudinal sectional view of the end portion of another embodiment of a composite insulator 1, in which the cavity also comprises two partial cavities, which, however, are not separated from one another through the corona shield as in FIG. 1; furthermore.
Figure 5:
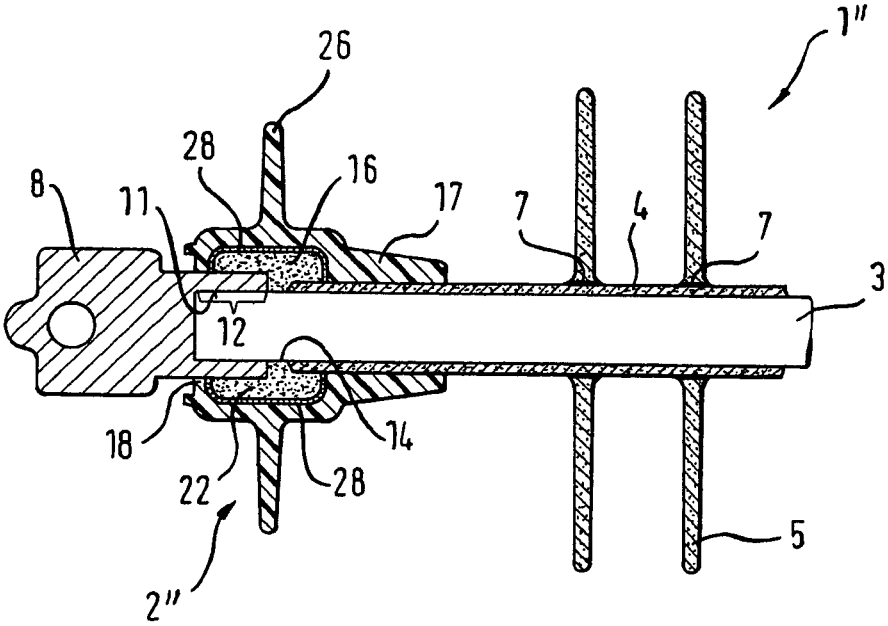
FIG. 5 shows an illustration of another embodiment according to FIG. 4, in which the cavity of the corona shield is not divided into partial cavities according to FIGS. 1 and 4; furthermore.

In the embodiments illustrated in FIGS. 1 and 4, the insulating jacket 4 was produced in a joint casting process together with the ribs 5 through casting about the rod 3. Accordingly, there are no microstructure boundaries in FIGS. 1 and 4 between the insulating jacket 4 and the ribs 5. In the embodiment of FIG. 5, the insulating jacket 4 and the ribs 5 are produced separately. Accordingly, microstructure boundaries 7 are provided between the insulating jacket 4 and the ribs 5.

In the portion of both of its ends, the rod 3 is not enveloped; the insulating jacket 4 thus ends already at a distance from the rod end, which is described infra in more detail.

End fittings 8 are attached respectively at the ends of the rod 3. The end fittings 8 are prefabricated from components made of metal. A head fitting 8*a* is used e.g. for mounting the insulator 1 to a high voltage mast, and is provided e.g. with a bore hole 9 for mounting bolts for this purpose. The end fitting 8 at the other end is a base fitting 8*b*, which is used e.g. to mount a conductor at the insulator 1. For this purpose, the base fitting 8*b* e.g. comprises a circumferential groove 10.

The end fittings 8 respectively comprise a receiving hole 11 for the rod 3. In a lower section 12, said receiving hole 11 has an interior diameter in the non-assembled state of the insulator 1, which interior diameter is larger than the exterior diameter of the rod 3, so that said rod can be inserted into said lower hole section 11 without substantial force. The end fitting 8 is crimped on the outside after inserting the rod 3, and thus crimped in a portion, which corresponds approximately to the lower hole section 12. Said portion forms the so-called crimping portion. It is designated as 12*a* in FIG. 1. The end fitting 8 is permanently plastically deformed through crimping in the crimping portion 12*a*, so that the wall of the lower hole section 12 presses onto the rod 3 with a relatively large force, which is establishes a non-disengageable friction lock connection between the rod 3 and the end fitting 8.

The interior hole diameter is larger in a hole section 13 disposed more proximal to the entry of the hole, and thus larger than the exterior diameter of the insulating jacket 4 by an amount, so that the annular cavity formed thereby between the wall of the hole and the insulating jacket can be filled with flow capable sealant compound.

The length of the non-encased rod end is slightly greater than the length of the lower hole section 12. Thus, the portion of the rod 3 crimped together with the end fitting 8 is not enveloped, the press fit thus exists between the end fitting 8 and the rod 3, but not between the insulating jacket 4 and the rod. Viewed from the center of the insulator 1, the insulating jacket 4 reaches into the hole section 13 with the larger diameter. However, it ends already slightly before the beginning of the lower hole section 12, in order to prevent that the insulating jacket 4 contacts the contraction at the transition from the hole section 13 to the hole section 14 with its end. Between the end of the insulating jacket 4 and the beginning of the lower hole section 12, there is a short rod section 14 with a rod surface, which lies open initially, this means which is not enveloped initially. Viewed from the center of the insulator 1, thus in the hole section 13, there is initially a piece of rod 3 with an insulating jacket 4, whereas the rod section 14 with an initially open rod surface is disposed deeper in the hole section 13.

A corona shield 2 made of an insulating elastomer is disposed respectively at the transition portion 15 between the rod 3 and the end fitting 8. The corona shield 2 is a separately fabricated formed component, thus it is not fabricated by casting about the rod 3 like the insulating jacket 4 and the ribs 5. The formed component of the corona shield 2 comprises a cavity 16 in its interior, which cavity is open towards the inside, thus towards the rod/the insulating jacket/the end fitting, and which is closed in outward direction by the corona shield 2. In order to pass the rod 3 provided with the insulating jacket 4 or the end fitting 8 through, the corona shield 2 respectively comprises a suitable pass-through opening in axial direction. Said pass-through opening is adapted with its inner diameter to the outer diameter of the insulating jacket 4, or it is adapted to the outer diameter of the end fitting 8, in the end portion of the end fitting 8 which is of interest here, and thus forms a rod side closing cuff 17 or an fitting side closing cuff 18 for sealing the cavity 16 in axial direction. Since the end fitting 8 encloses the rod 3 including the insulating jacket 4, the outer diameter of the end fitting 8 is greater than the outer diameter of the insulating jacket 4. Thus, the inner diameter of the fitting side closing cuff 18 is greater than the inner diameter of the rod side closing cuff 17.

The end fitting wall 19 above the hole section 13 thus covers the end of the insulating jacket 4 and the rod section 14 and forms an annular cavity 16*a* therein, which leads into an annular gap at the face of the end fitting 8. The inner wall of the cavity 16 forms a shoulder 21 substantially extending in radial direction, which contacts the end fitting 8 with its face and thus closes the annular gap 20. Thus, the end fitting 8 with its wall 19 and the shoulder 21 divide the cavity 16 into two partial cavities, thus an inner cavity 16*a*, which was already introduced supra as the "annular cavity 16*a*", and an outer cavity 16*b*. The inner cavity 16*a* extends about the end of the insulating jacket 4 and about the section 14. As recited supra, it is defined on the radial outside by the wall 19 of the end fitting 8, in axial direction viewed away from the insulator center, it is defined by the hole contraction towards the hole section 12, and in axial direction viewed towards the insulator center, it is defined by the shoulder 21. The outer cavity 16*b* envelopes the end fitting 8 in the portion of the hole section 13. It is defined in radially inward direction by the wall 19 of the end fitting 8 and in all other directions it is defined by the inner wall of the corona shield 2. A connection channel (FIG. 2) provides fluidic communication between two partial cavities 16*a, b.*

The cavity 16, and thus the inner cavity, as well as the outer cavity 16*a, b*, is completely filled in the finished insulator with a hardened, electrically insulating sealant compound 22. The sealant compound 22 thus covers in particular the end of the insulating jacket 4 and the section 14 with initially openly disposed rod section in the inner cavity 16*a* in a sealing manner.

On the outside, the corona shield 8 comprises a radially extending rib 26, which is used for extending the creep distance. Furthermore, it comprises groove shaped protrusions 23 on the outside at its fitting side closing cuff, which protrusions serve as a rainwater runoff.

Figure 2:
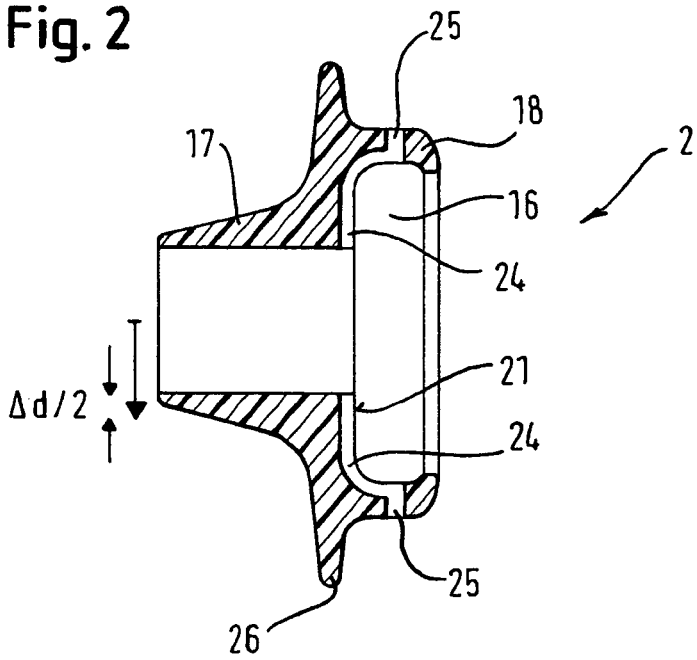
FIG. 2 shows a respective sectional view of one of the corona shields of FIG. 1.
Figure 3:
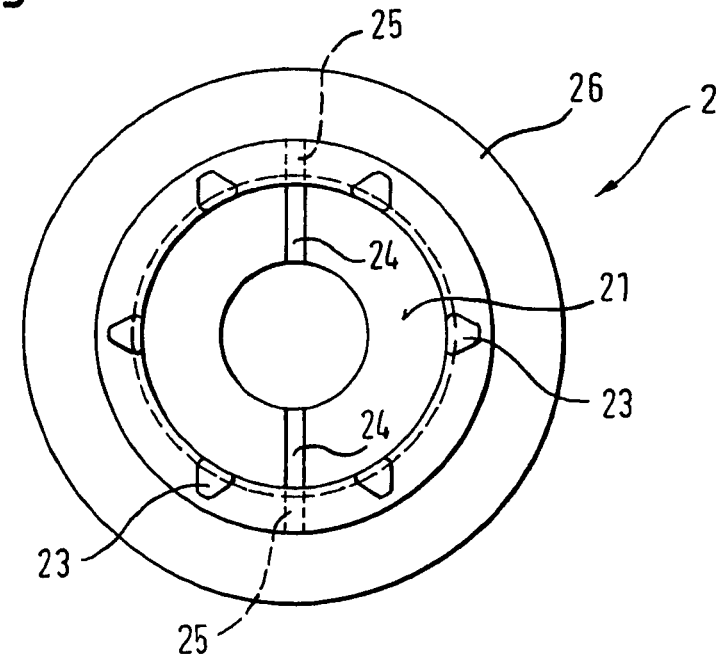
FIG. 3 shows a view into the corona shield of FIG. 1 along the insulator axis.

FIG. 2 now shows one of the corona shields, which is only schematically illustrated in FIG. 1, in a sectional view corresponding to FIG. 1. FIG. 3 shows a corresponding view in axial direction. Due to the larger scale, more realistic sizes and additional details are illustrated in FIGS. 2 and 3. Different from FIG. 1, the FIGS. 2 and 3 show the corona shield in the condition in which it is provided as a prefabricated not yet installed formed component. In particular, the cavity 16 is not yet filled with sealant compound in said condition.

As already illustrated in conjunction with FIG. 1, the corona shield 2 comprises a rod side closing cuff 17 with smaller diameter and a fitting side closing cuff 18 with larger diameter. The inner diameters of the closing cuffs 17, 18 are smaller by an expansion dimension Δd than the exterior diameter of the insulating jacket 4 or the exterior diameter of the end fitting 8 (FIG. 2). In installed condition, the closing cuffs 17, 18 are elastically expanded by Δd, thus the designation "expansion dimension". The expansion dimension Δd is disposed between 0% and 30% with reference to the exterior diameter of the insulating jacket 4 or of the end fitting 8.

The cavity 16 comprises an inner diameter at its widest location, which inner diameter is slightly larger than the inner diameter of the larger, this means fitting side, closing cuff 18. The shoulder 21 closes the cavity towards rod side closing cuff 17 as described in conjunction with FIG. 1. Said shoulder forms a contact surface for the face of the end fitting 8 for closing the annular gap 20 provided at this location. In the embodiment illustrated in FIG. 1, the cavity 16 does not extend beyond the step 21 in axial direction towards the center of the insulator. The closing cuff 17 tightly contacting the insulating jacket 4 rather begins already at the shoulder 21. Said closing cuff is configured significantly longer in axial direction towards the insulator center, than it would be required solely for sealing the cavity 16. The closing cuff 17 thus forms a cover grommet for the insulating jacket 4, which increases the wall thickness of the insulating jacket 4 in the particularly erosion prone portion of the rod 3 proximal to the end fitting 8. The outer contour of the cover grommet 17 contracts conically viewed in the direction towards the insulator center.

Plural (herein two) connection channels 24 extend in the shoulder 19, which connection channels provide fluidic communication between the partial cavities 16*a*, 16*b*, created during installation. In order to be able to simply fill the cavity 16 with sealant 22 from the outside, thus plural (herein two) filling channels 25 are additionally provided. They extend in radial direction from the outside of the corona shield 2 to the cavity 16. The two filling channels 25 provided in the embodiment of FIG. 2 are thus disposed opposite to one another. Thus, when the corona shield 2 is oriented, so that one of the filling channels 25 is oriented downward, the other one is oriented upward. The same applies accordingly for the disposition of the two connection channels 24.

The connection channels 24 comprise the shape of longitudinal indentations, which extend openly in the inner wall of the cavity 16 and thus in particular in the shoulder 21. They start respectively at the inner outlet of the respective filling channel 25 and lead from there to the shoulder 21, and in the shoulder 21 radially towards the inside, and eventually open into the inner cavity 16*a* at the beginning of the rod side closing cuff 17. When the shoulder 21 contacts the face of the fitting wall 19 in installed condition, the sealant compound 22 can flow in the connection channel 24 past the face of the wall 19. Since the connection channel 24 is open towards the inner cavity 16*a*, the sealant compound 22 can exit from the connection channel 24 immediately after passing said obstacle and can thus enter the inner cavity 16*a* and fill it.

Filling the corona shield 2 with flow capable sealant compound 22 is accomplished e.g. as follows: the corona shield 2 is already placed at the correct position in the transition portion 15 of the composite insulator 1. The corona shield 2 or the insulator 1 has already been placed at the correct location on the interface 15 of the composite insulator 1. The corona shield 2 or the insulator 1 has already been rotated into a position, so that the filling channels 25 extend in vertical direction. The sealant compound 22 is then slowly injected through the filling channel 25 disposed below. The level of the sealant compound 22 thus continuously rises in the cavity 16, initially only in the outer cavity 16*b*, and due to the flow through of the connection channel 24 disposed below, it then also rises in the inner cavity 16*a*. Air displaced by the sealant compound 22 exhausts from the inner cavity 16*a* through the connection channel 24 and the cavity 16 through the filling channel 25 disposed above. Sealant compound 22 exhausting from the filling channel 25 disposed above indicates that the entire cavity 16 has been filled. The filling process can then be terminated. In order to prevent an outflow of not yet hardened sealant compound 22 after removing the injection device, the lower and possibly also the upper filling channel 25*b* are closed e.g. by a plug.

FIG. 4 shows a schematic illustration of a longitudinal sectional view of another embodiment of the composite insulator 1', corresponding to FIG. 1, wherein only one end of the insulator 1' is shown. The embodiment of FIG. 4 differs from the embodiment of FIG. 1 in that the inner wall of the corona shield 2' does not contact the wall 19 of the end fitting 8 with its face, but is offset from said wall. Though, also here, an inner cavity 16*a* and an outer cavity 16*b* are provided, the corona shield 2' thus does not separate said two partial cavities from one another, they are rather in fluidic communication with one another through the annular gap 20. The function of the connection channels 24 of FIG. 1 is thus also taken over by the open annular gap 20. The initially flow capable sealant compound 22 thus fills the inner cavity 16*a* through the open annular gap 20. Besides the differences recited herein, all statements made in conjunction with FIGS. 1 through 3 apply to the embodiment of FIG. 4.

In the embodiment of FIG. 4, the interface between the insulating jacket 4 and the rod side closing cuff or cover grommet 17 have been glued together with glue. The gluing interface thus provided is designated as 27 in FIG. 4. It is appreciated that a glue joint of that type is not limited to embodiments according to FIG. 4, but that it can also be used in embodiments according to FIG. 1 or FIG. 5. On the other hand, the corona shield 2' can be used without such a glue joint in embodiments according to FIG. 4.

FIG. 5 eventually shows another embodiment of a composite insulator 1" in a schematic view similar to FIG. 4, in which, however, the mounting hole 12 in the end fitting 8 does not comprise a hole section 13 with a larger diameter than the rod diameter, which is different from the embodiments of FIGS. 1 through 4. The mounting hole 12 in the end fitting 8 actually rather comprises a diameter over its entire length, which diameter corresponds to the exterior diameter of the rod 3 without the insulating jacket 4. Thus, actually the entire hole 12 in this embodiment forms the crimping portion 12*a*. Due to the hole section 13 with larger diameter being omitted, the section 14 in this embodiment, which is initially provided with an open rod surface, is not covered by a wall of the end fitting 8, but only by the corona shield 2". Consequently herein, the cavity 16 does not comprise an inner- or outer cavity, but it forms a uniform cavity, which is only enveloped by a corona shield 2" on the outside.

The base body of the corona shield 2" is in turn made from electrically non-conductive plastic material, e.g. silicone rubber, however, it is provided with a semiconducting lacquer layer 28 at its inner surface, but not in the rod side closing cuff 17. Said lacquer layer contacts the surface of the fitting 8 with the fitting side closing cuff 18, and it is thus electrically at the potential of the respective end fitting 8. The jacket 4 and the ribs 5 are separately produced in the embodiment of FIG. 5, so that a microstructure boundary 7 which is filled with glue is disposed between them.

In the embodiment of FIG. 5, the insulating jacket 4 and the ribs 5 are manufactured separately. Accordingly, microstructure boundaries 7 between the insulating jacket 4 and the ribs 5 are disposed at this location.

Besides these differences, all statements made in conjunction with FIGS. 1 through 4 apply to the embodiment of FIG. 5. It is appreciated that the configuration with a semiconducting layer 28 and/or the separate fabrication of the insulating jacket 4 and ribs 5 are not restricted to embodiments with a corona shield according to FIG. 5, but they can also be used in embodiments with a corona shields according to FIG. 1 or 4. On the other hand, also a purely insulating configuration of the corona shield and/or the integral fabrication of insulating jacket and ribs can be used in embodiments with a corona shield according to FIG. 5.

The described embodiments show composite insulators with longer service life, which can be produced with relatively minor effort, and corona shields for their fabrication.

All publications and existing systems recited in this specification are hereby incorporated in their entirety by reference.

Although certain products constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalence.

What is claimed is:

1. A composite insulator, comprising:

a rod with an insulating jacket and ribs, wherein the insulating jacket and the ribs are made of an insulating plastic material;

at least one end fitting; and a corona shield fabricated as a separate formed component that is coaxially disposed on the composite insulator at an interface region between the rod and the end fitting, and whose cavity is filled with a sealant compound, wherein the corona shield is integrally made from a plastic material in one piece, wherein the corona shield originally forms the cavity that is open towards an inside that is filled with the sealant compound through at least one filling channel, wherein the corona shield includes a closing cuff in axial direction on both sides to seal the cavity, wherein a diameter of the rod side closing cuff is adapted to a diameter of the insulating jacket, and a diameter of the end fitting side closing cuff is adapted to a diameter of the end fitting, wherein the filling channel leads to the cavity from an outside;

wherein the rod is crimped to the end fitting in a hole of the end fitting forming a crimping portion, wherein the end fitting includes a portion in front of the crimping portion in which the hole has a larger diameter than the insulating racket, and the insulating jacket extends into the hole, wherein the interface region, where the rod enters the crimping portion, is covered by the cavity and sealed by the sealant compound disposed in the cavity, wherein the interface region includes a first section in which the rod is enveloped by the insulating jacket and a second section in which the rod is not enveloped by the insulating jacket, wherein the sealant compound covers both the first section and the second sections, wherein the end fitting in the cavity forms two partial cavities, an inner cavity and an outer cavity, wherein the inner cavity extends about the end of the insulating jacket and the second section, and wherein the inner and the outer cavity between the first and second sections are filled with the sealant compound.

2. A composite insulator according to claim 1, wherein a wall of the cavity contacts a face of the end fitting so that the end fitting divides the cavity in the inner and the outer cavity, and wherein a connection channel is provided for providing fluidic communication between the inner and outer cavities.

3. A composite insulator according to claim 1, wherein the inner cavity and the outer cavity are in fluidic communication with each other through an annular gap.

4. A composite insulator according to claim 2, wherein the cavity of the corona shield comprises a shoulder, and wherein the shoulder contacts the face of the end fitting, so that the end fitting and the shoulder separate the cavity into the inner cavity and the outer cavity.

* * * * *